US007036199B1

(12) United States Patent
Hicks

(10) Patent No.: US 7,036,199 B1
(45) Date of Patent: May 2, 2006

(54) TAPER KEY REMOVAL APPARATUS

(76) Inventor: Dolen E. Hicks, 508 W. Rial To Ave., Stockton, CA (US) 95207

( * ) Notice: Subject to any disclaimer, the term of this patent is extended or adjusted under 35 U.S.C. 154(b) by 0 days.

(21) Appl. No.: 11/076,827

(22) Filed: Mar. 10, 2005

(51) Int. Cl.
*B25B 27/14* (2006.01)

(52) U.S. Cl. ..... 29/275; 254/25

(58) Field of Classification Search ..... 29/275, 29/278; 254/25, 104; 269/217, 190, 238
See application file for complete search history.

(56) References Cited

U.S. PATENT DOCUMENTS

| | | | | |
|---|---|---|---|---|
| 154,926 | A * | 9/1874 | Stimson | 254/25 |
| 619,304 | A * | 2/1899 | Herzog | 254/104 |
| 1,951,537 | A | 3/1934 | Thompson | |
| 2,542,368 | A * | 2/1951 | Smith | 29/275 |
| 2,562,412 | A | 7/1951 | Brooks | |
| 2,772,596 | A * | 12/1956 | Trussell | 411/535 |
| 3,602,969 | A * | 9/1971 | Provost | 29/275 |
| 3,873,068 | A * | 3/1975 | Allen | 254/131 |
| 4,297,921 | A | 11/1981 | Wydra | |
| D336,413 | S | 6/1993 | Ebert | |
| 5,845,381 | A | 12/1998 | Cuddy | |
| 6,351,881 | B1 * | 3/2002 | Peckich et al. | 29/275 |
| 6,364,289 | B1 * | 4/2002 | Cook | 254/104 |
| 6,752,380 | B1 * | 6/2004 | Taylor et al. | 254/25 |

* cited by examiner

*Primary Examiner*—Lee D. Wilson

(57) ABSTRACT

A taper key removal apparatus includes a body including a shank section. The shank section includes a beveled striking surface monolithically formed therewith. The body further includes a tip section monolithically formed with the shank section. Such a tip section extends forwardly of the shank section and includes an end portion. The tip section has a substantially planar front face extending partially along the length of the body and terminating at the end portion. A shim is positioned between the body and a gear and for maintaining the gear at a substantially stable position during operating conditions. Such a shim has opposed end portions and substantially planar front and rear portions. An aperture is formed proximate to one end portion and generally medially of the sidewalls.

19 Claims, 2 Drawing Sheets

TAPER KEY REMOVAL APPARATUS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to hand-operable mechanical tools and, more particularly, to a manually operable taper key removal apparatus.

2. Prior Art

Tapered keys are commonly used with heavy machinery to lock a hub onto a shaft. Tapered keys accomplish this function when forcefully lodged into a notch, cut lengthwise on the shaft periphery, thereby expanding the shaft into a tight fit with the surrounding hub.

Specifically, tapered keys are employed to hold a sprocket, gear, flywheel, coupling or other such device onto a shaft, enabling such devices to turn or rotate with the shaft. Tapered keys are generally made of steel and are available in a variety of sizes, with a substantially rectangular shape that tapers on one side at a rate of approximately ⅛" per foot. The larger end of a tapered key forms a rectangular block which can be pounded with a hammer to lodge the key into place. The block of a tapered key is not pounded flush against a hub, but extends out such that a space of approximately 1" remains between the hub and the key block. On occasion, tapered keys will fracture under stress or otherwise require removal. Removal of a tapered key is difficult since they are lodged tightly in order to effectively secure one of the aforementioned devices to a shaft.

Removal of a tapered key is usually accomplished by pounding a wedge or other object between the hub and the block of the key in such a manner as to loosen the key from its position. If insufficient space exists between the hub and the key block or if the key is lodged too securely to effectively pry the key loose in this manner, an extension of some sort must be welded onto the end of the block such that the key can be pulled out by its extension. In either case, removal is difficult and time consuming. In addition, these methods are haphazard and can result in damage to the equipment and machinery involved or to the key itself.

Accordingly, a need remains for a taper key removal apparatus to over-come the above-noted shortcomings. The present invention satisfies such a need by providing a tool that facilitates the removal of such keys from gears, sprockets, and cams. Such an apparatus is easily struck by a hammer and may be used for removal and installation of taper keys. The present invention advantageously preserves the integrity of the taper keys by removing them undamaged, thereby permitting them to be reused, saving user's time and money.

BRIEF SUMMARY OF THE INVENTION

In view of the foregoing background, it is therefore an object of the present invention to provide an apparatus for facilitating the removal of taper keys from gears and other toothed devices. These and other objects, features, and advantages of the invention are provided by an apparatus including a body including a shank section sized and shaped for being grasped by a user. The shank section includes a beveled striking surface monolithically formed therewith for being struck by a user during operating conditions. The body further includes a tip section monolithically formed with the shank section. Such a tip section extends forwardly of the shank section and includes an end portion. The tip section has a substantially planar front face extending partially along the length of the body and terminating at the end portion. Such a tip section decreases in thickness towards the end portion.

A shim is positioned between the body and a gear and for maintaining the gear at a substantially stable position during operating conditions. Such a shim has opposed end portions and substantially planar front and rear portions. A plurality of sidewalls are monolithically formed therebetween. An aperture may be formed proximate to one end portion and generally medially of the sidewalls. In a preferred embodiment, the end portion is preferably beveled. In such an embodiment, the end portion of the tip section may be vertically registered with the width of the shank section. In such an embodiment, the front face preferably has an arcuate shape. In an alternate embodiment, the end portion is preferably flat and may be offset from the vertical axis.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
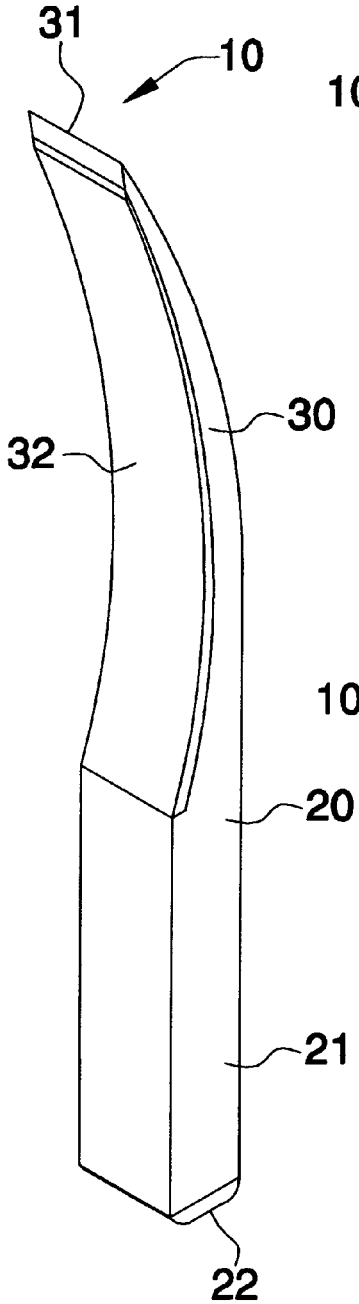
FIG. 1 is a perspective view showing a taper key removal apparatus, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures and prime and double prime numbers refer to alternate embodiments of such elements.

The apparatus of this invention is referred to generally in FIGS. 1–7 by the reference numeral 10 and is intended to provide a tool for facilitating the removal of taper keys. It should be understood that the apparatus 10 may be used to remove many different types of keys and objects and should not be limited to use only for removing taper keys.

Figure 2:
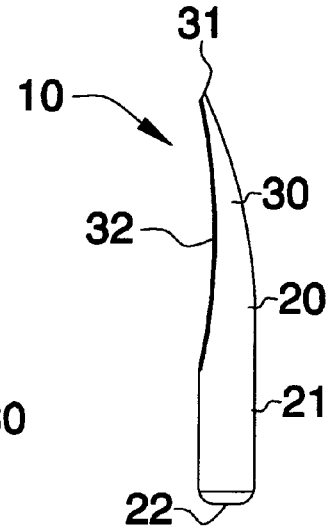
FIG. 2 is a side elevational view of the apparatus in FIG. 1.
Figure 3:
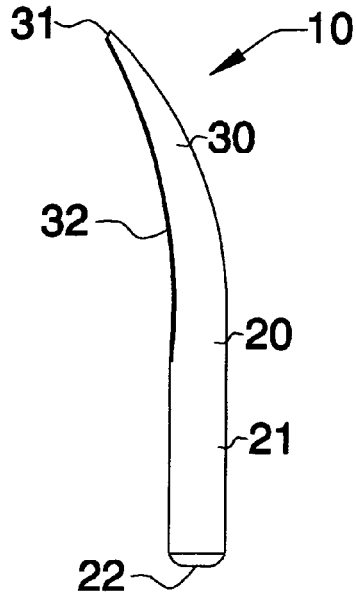
FIG. 3 is a side elevational view of the apparatus in FIG. 1, showing the front face beginning generally medially of the body.

Referring initially to FIGS. 1–3, the apparatus 10 includes a body 20 including a shank section 21 sized and shaped for being grasped by a user. The shank section 21 includes a beveled striking surface 22 monolithically formed therewith for being struck by a user during operating conditions. Such a striking surface is preferably formed from hardened steel, to absorb the impact of a hammer or other blunt object without incurring damage or wear. The bevel shape of such a surface prevents mushrooming when absorbing blows. The body 20 further includes a tip section 30 monolithically formed with the shank section 21. Such a tip section 30 extends forwardly of the shank section 21 and includes an end portion 31. The tip section 30 has a substantially planar front face 32 extending partially along the length of the body 20 and terminating at the end portion 31. Such a tip section 30 decreases in thickness towards the end portion 31.

Figure 7:
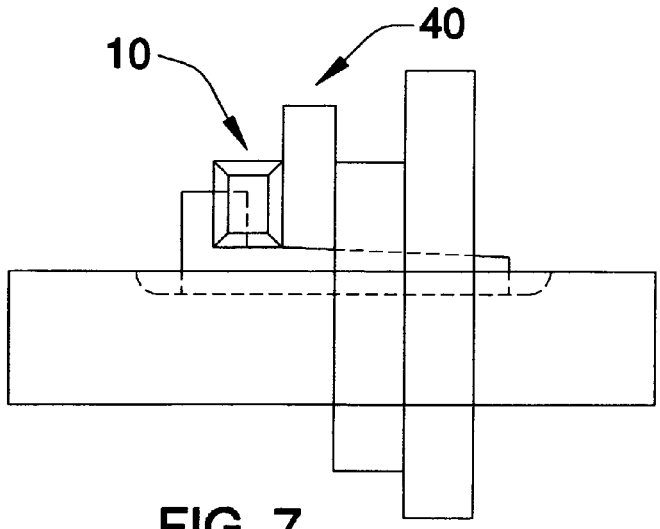
FIG. 7 is a side elevational view showing the present invention in a preferred environment.

Referring to FIG. 7, a shim 40 is positioned between the body 20 and a gear and for maintaining the gear at a substantially stable position during operating conditions. Such a shim 40 allows a loosened taper key to be forced out and is mounted between the body 20 and the gear. Now referring to FIG. 6, such a shim 20 has opposed end portions 41A, 41B and substantially planar front 42 and rear portions (not shown). A plurality of sidewalls 44 are monolithically formed therebetween. An aperture 45 is preferably formed proximate to one end portion 41A and generally medially of the sidewalls 44.

Figure 4:
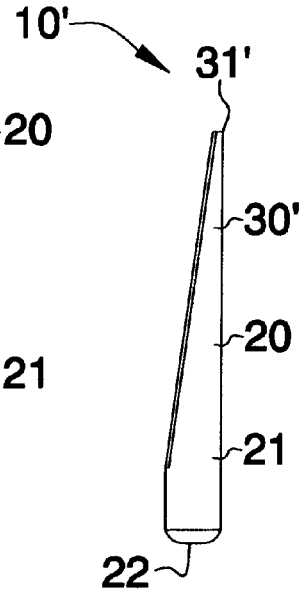
FIG. 4 is a side elevational view of an alternate embodiment of the apparatus shown in FIG. 1, showing the end portion offset from the vertical axis.
Figure 5:
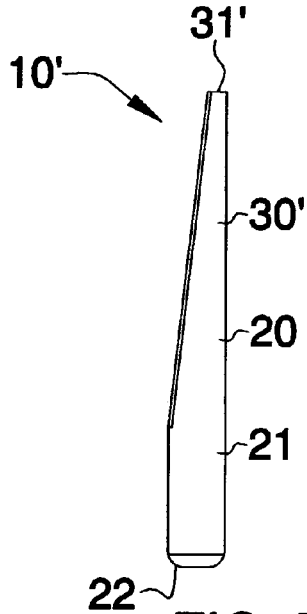
FIG. 5 is a side elevational view of an alternate embodiment of the apparatus shown in FIG. 1, showing the front face beginning generally medially of the body.
Figure 6:
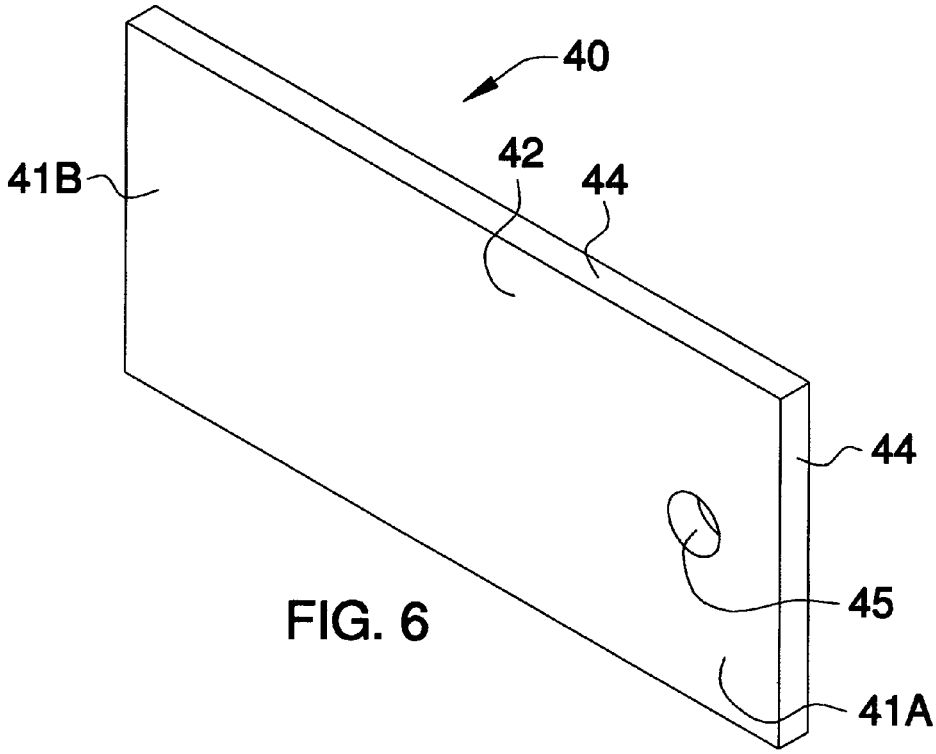
FIG. 6 is a perspective view of the shim.

Referring to FIGS. 1–3, in a preferred embodiment 10, the end portion 31 is preferably beveled. In such an embodiment 10, the end portion 31 of the tip section 30 is preferably vertically registered with the width of the shank section 21. In such an embodiment, the front face 32 preferably has an arcuate shape. Referring to FIGS. 4 and 5, in an alternate embodiment 10', the end portion 31' of the tip section 30' is preferably flat and may be offset from the vertical axis.

In operation, the tip section 30 is inserted through the far or inner side of a keyway. The striking surface 22 is then struck with a hammer, thereby pushing the key out. Such a removal apparatus 10 could also be used to tap keys in place during assembly. The apparatus 10 substantially reduces the amount of time and effort required to remove taper keys when removing cams, gears, and sprockets. Such an apparatus 10 conveniently allows a user to change gears, cams, or sprockets without damaging the taper key or shaft, thereby allowing the taper key and shaft to be reused.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined body and shim for facilitating the removal of taper keys from gears and other toothed devices, said combined body and shim comprising:

a body including a shank section sized and shaped for being grasped by a user, said shank section including a beveled striking surface monolithically formed therewith for being struck by a user during operating conditions, said body further including a tip section monolithically formed with said shank section, said tip section extending forwardly of said shank section and including an end portion, said tip section having a substantially planar front face extending partially along the length of the body and terminating at said end portion, said tip section decreasing in thickness towards said end portion; and a shim positional between said body and a gear for maintaining the gear at a substantially stable position during operating conditions, said shim having opposed end portions, said shim further having substantially planar front and rear portions and a plurality of sidewalls monolithically formed therebetween.

2. The combined body and shim of claim 1, wherein said end portion is beveled.

3. The combined body and shim of claim 1, wherein said end portion is flat.

4. The combined body and shim of claim 1, wherein said tip section is vertically registered along a width of said shank section.

5. The combined body and shim of claim 1, wherein said tip section is offset from a vertical axis.

6. The combined body and shim of claim 1, wherein said front face has an arcuate shape.

7. The combined body and shim of claim 1, wherein said shim has an aperture formed proximate to said shank section.

8. The combined body and shim of claim 1, wherein said end portion is beveled.

9. The combined body and shim of claim 1, wherein said end portion is flat.

10. The combined body and shim of claim 1, wherein said tip section is vertically registered along a width of said shank section.

11. The combined body and shim of claim 1, wherein said tip section is offset from a vertical axis.

12. The combined body and shim of claim 1, wherein said front face has an arcuate shape.

13. A combined body and shim for facilitating the removal of taper keys from gears and other toothed devices, said combined body and shim comprising:

a body including a shank section sized and shaped for being grasped by a user, said shank section including a beveled striking surface monolithically formed therewith for being struck by a user during operating conditions, said body further including a tip section monolithically formed with said shank section, said tip section extending forwardly of said shank section and including an end portion, said tip section having a substantially planar front face extending partially along the length of the body and terminating at said end portion, said tip section decreasing in thickness towards said end portion; and a shim positional between said body and a gear for maintaining the gear at a substantially stable position during operating conditions, said shim having opposed end portions, said shim further having substantially planar front and rear portions and a plurality of sidewalls monolithically formed therebetween, said shim having an aperture formed proximate to said shank section.

14. A combined body and shim for facilitating the removal of taper keys from gears and other toothed devices, said combined body and shim comprising:

a body including a shank section sized and shaped for being grasped by a user, said shank section including a beveled striking surface monolithically formed therewith for being struck by a user during operating conditions, said body further including a tip section monolithically formed with said shank section, said tip section extending forwardly of said shank section and including an end portion, said tip section having a substantially planar front face extending partially along the length of the body and terminating at said end portion, said tip section decreasing in thickness towards said end portion; and a shim positional between said body and a gear for maintaining the gear at a substantially stable position during operating conditions, said shim having opposed end portions, said shim further having substantially planar front and rear portions and a plurality of sidewalls monolithically formed therebetween, said shim having an aperture formed proximate to said shank section and generally medially of said sidewalls;

wherein said shank section has a plurality of monolithically formed walls such that said shank section has a square cross-section, wherein said shim has a thickness less than a thickness of said shank section, wherein one of said front and rear faces of said shim being directly intercalated between said body and the gear, wherein said sidewalls of said shim having a longitudinal length greater than a longitudinal length of said end portions of said shim, wherein said striking surface being formed at one end portion of said body that opposes said end portion of said tip section.

15. The combined body and shim of claim 1, wherein said end portion is beveled, wherein said tip section has a longitudinal length greater than a longitudinal length of said shank.

16. The combined body and shim of claim 1, wherein said end portion is flat.

17. The combined body and shim of claim 1, wherein said tip section is vertically registered along a width of said shank section.

18. The combined body and shim of claim 1, wherein said tip section is offset from a vertical axis.

19. The combined body and shim of claim 1, wherein said front face has an arcuate shape.

* * * * *